US011945642B2

(12) United States Patent
Mooney et al.

(10) Patent No.: US 11,945,642 B2
(45) Date of Patent: Apr. 2, 2024

(54) SPRUNG DISPENSING TOWER WITH RESILIENTLY COMPRESSIBLE SLIDE GUIDE

(71) Applicant: Main St. Group, Woodstock (CA)

(72) Inventors: Bob Mooney, Woodstock (CA); Darrell Holmes, Woodstock (CA); Kevin Mitchell, Woodstock (CA)

(73) Assignee: Main St. Group, Woodstock (CA)

( * ) Notice: Subject to any disclaimer, the term of this patent is extended or adjusted under 35 U.S.C. 154(b) by 106 days.

(21) Appl. No.: 17/717,853

(22) Filed: Apr. 11, 2022

(65) Prior Publication Data

US 2022/0234813 A1 Jul. 28, 2022

(51) Int. Cl.
*A47F 1/06* (2006.01)
*B65D 83/00* (2006.01)

(52) U.S. Cl.
CPC ..... *B65D 83/0038* (2013.01); *A47F 1/06* (2013.01)

(58) Field of Classification Search
CPC ..... B65D 83/049
USPC ..... 221/279
See application file for complete search history.

(56) References Cited

U.S. PATENT DOCUMENTS

| | | | |
|---|---|---|---|
| 2,226,308 | A | 12/1940 | Gibbs |
| 2,426,995 | A | 9/1947 | Gibbs |
| 2,609,265 | A | 9/1952 | Larsen |
| 3,493,725 | A | 2/1970 | MacKay |
| 3,538,309 | A | 11/1970 | Welker |
| 3,565,500 | A | 2/1971 | Shelley |
| 3,664,546 | A | 5/1972 | Shelley |
| 3,675,912 | A | 7/1972 | Des Jardins |
| 3,724,715 | A | 4/1973 | Auriemma |
| 3,806,218 | A | 4/1974 | Cummings |

(Continued)

FOREIGN PATENT DOCUMENTS

| | | |
|---|---|---|
| EP | 1091670 A1 | 7/1999 |
| GB | 452870 B | 9/1936 |

(Continued)

*Primary Examiner* — Gene O Crawford
*Assistant Examiner* — Ayodeji T Ojofeitimi
(74) *Attorney, Agent, or Firm* — Dickinson Wright LLP; Matthew D. Powell

(57) ABSTRACT

Disclosed herein is a sprung dispensing tower that includes a vertical housing having an open top and an interior dimensioned to receive products in a vertical stacked relationship. The sprung dispensing tower includes a platform within the interior of the vertical housing, the platform having a horizontal component and platform sidewalls depending from the horizontal component in parallel with respective interior sidewalls of the vertical housing, the platform being vertically slideable within the interior of the vertical housing between an uppermost position and a lowermost position. The sprung dispensing tower includes a compressible spring associated with an underside of the platform and biasing the platform towards the uppermost position. The sprung dispensing tower includes a resiliently compressible slide guide affixed to at least a portion of the platform sidewalls and extending laterally towards the interior sidewalls of the vertical housing. The sprung dispensing tower includes at least one air passage below the lowermost position and extending through the vertical housing from the interior to an exterior of the vertical housing.

7 Claims, 16 Drawing Sheets

(56) References Cited

U.S. PATENT DOCUMENTS

| | | | | | |
|---|---|---|---|---|---|
| 3,871,641 | A * | 3/1975 | Marx | B65H 1/04 271/42 |
| 3,900,133 | A | 8/1975 | Lisbin et al. | |
| 4,357,127 | A | 11/1982 | Kooiman | |
| 4,449,760 | A | 5/1984 | House | |
| 4,503,980 | A | 3/1985 | Kooiman | |
| 4,927,053 | A | 5/1990 | Mayfield | |
| 5,080,258 | A * | 1/1992 | Hinterreiter | B65D 83/0418 221/229 |
| 5,199,600 | A | 4/1993 | Fietsam | |
| 5,954,226 | A * | 9/1999 | Peterson | B65H 1/12 271/2 |
| 2011/0132780 | A1* | 6/2011 | Marconi | F41A 9/65 224/196 |
| 2020/0329888 | A1 | 10/2020 | Cooper et al. | |
| 2021/0337984 | A1 | 11/2021 | Cooper et al. | |

FOREIGN PATENT DOCUMENTS

| | | | |
|---|---|---|---|
| GB | 928218 | B | 6/1963 |
| GB | 2227010 | A | 7/1990 |
| WO | WO9932018 | | 7/1999 |

* cited by examiner 10
120
10
100
P
11
10
5
100
MAIN ST.
15

FIG. 4
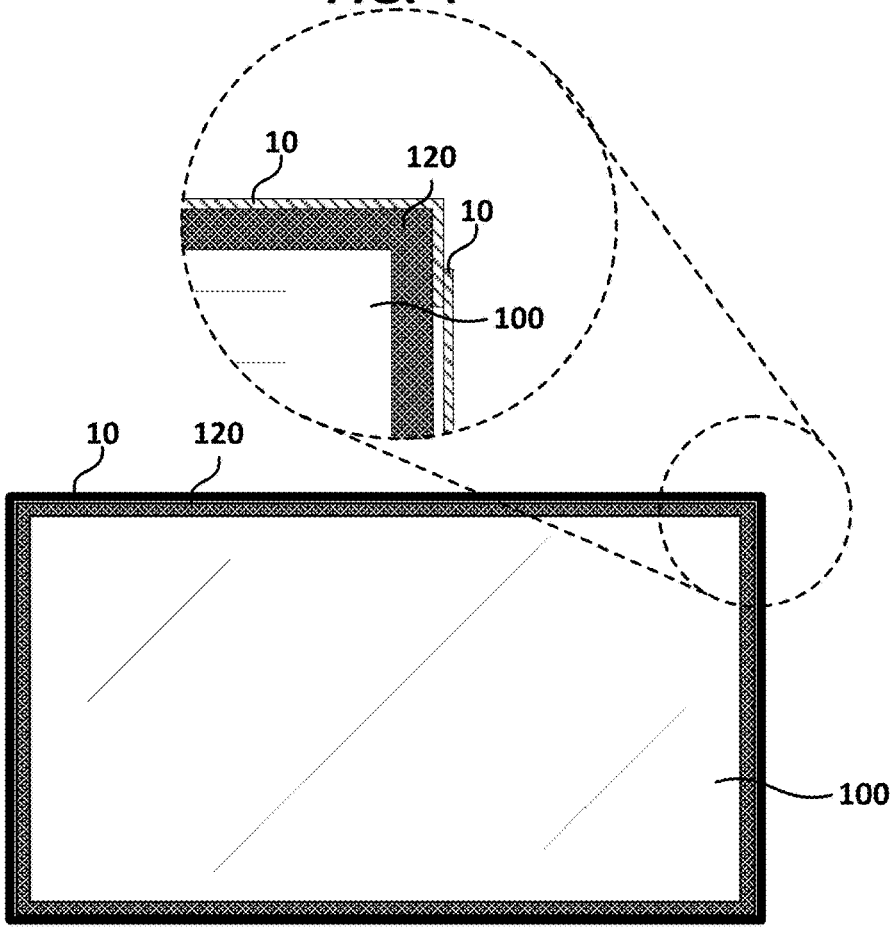
FIG. 3
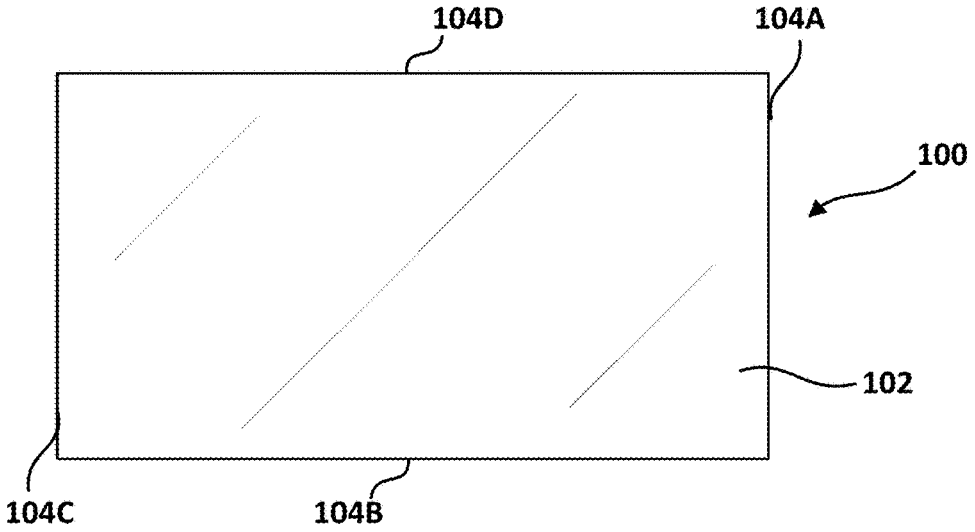
FIG. 5

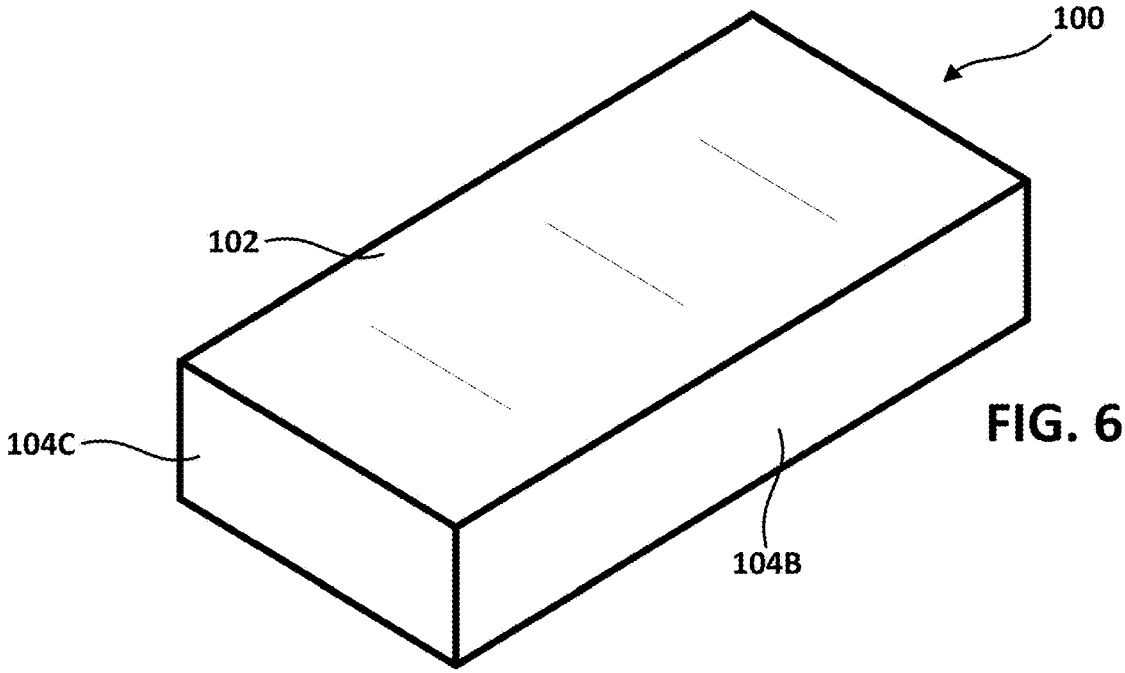
FIG. 6
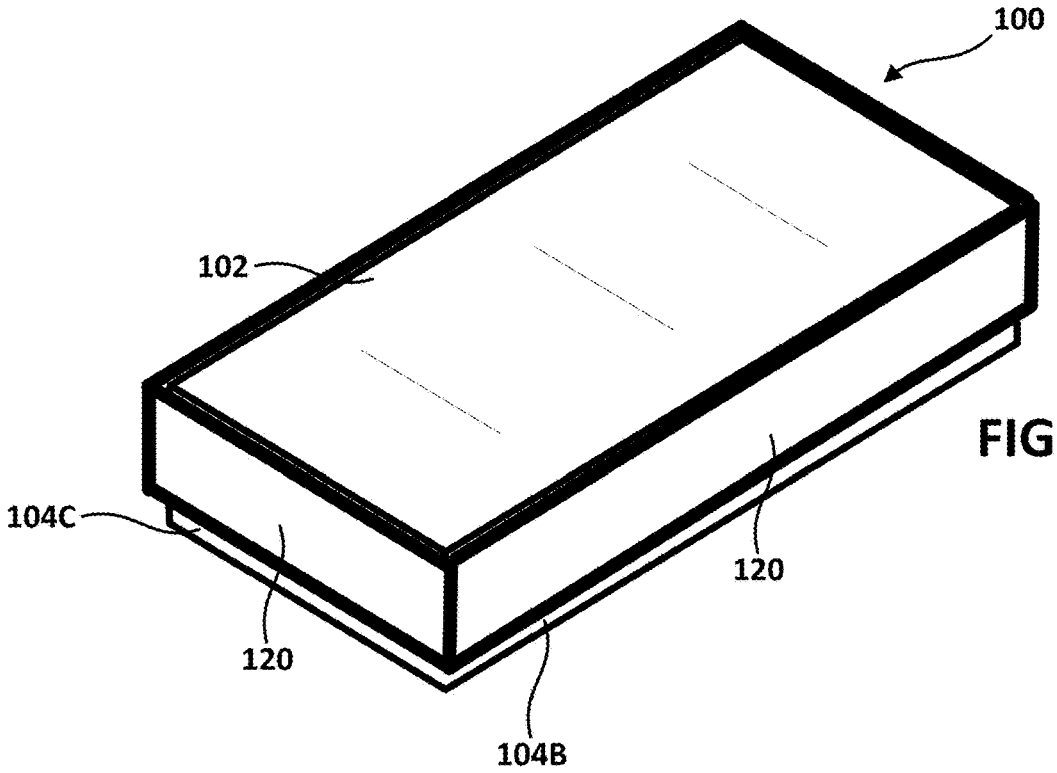
FIG. 7
FIG. 8
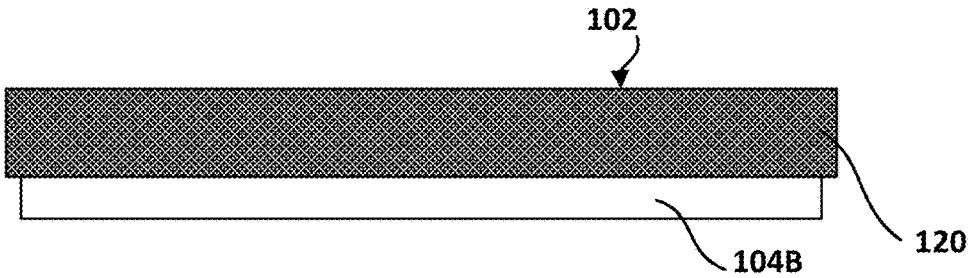

FIG. 23
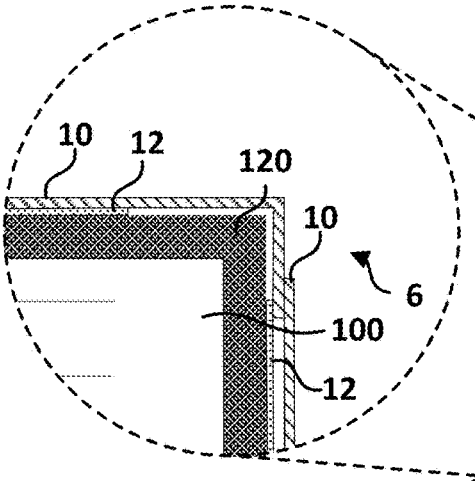
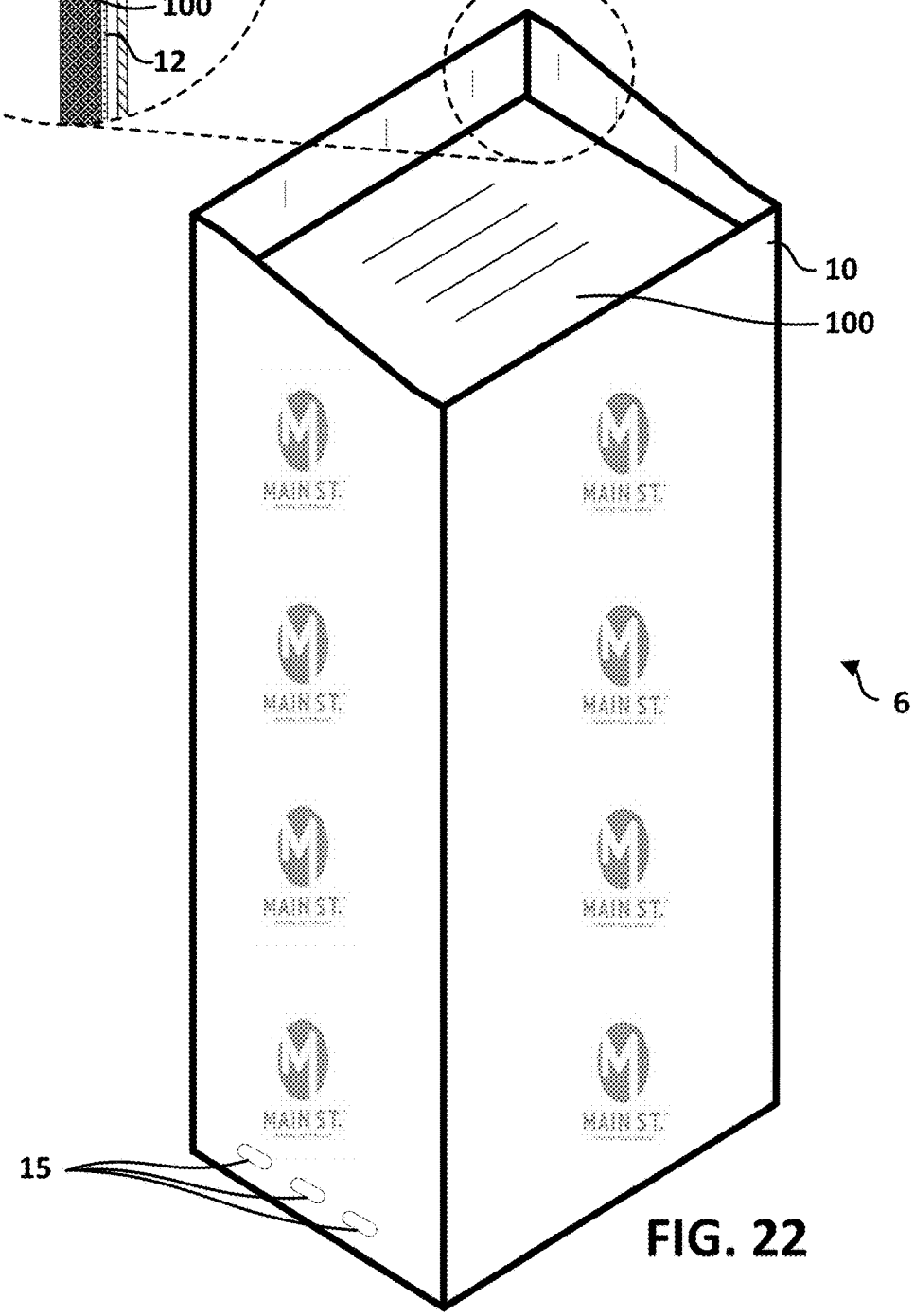
FIG. 22

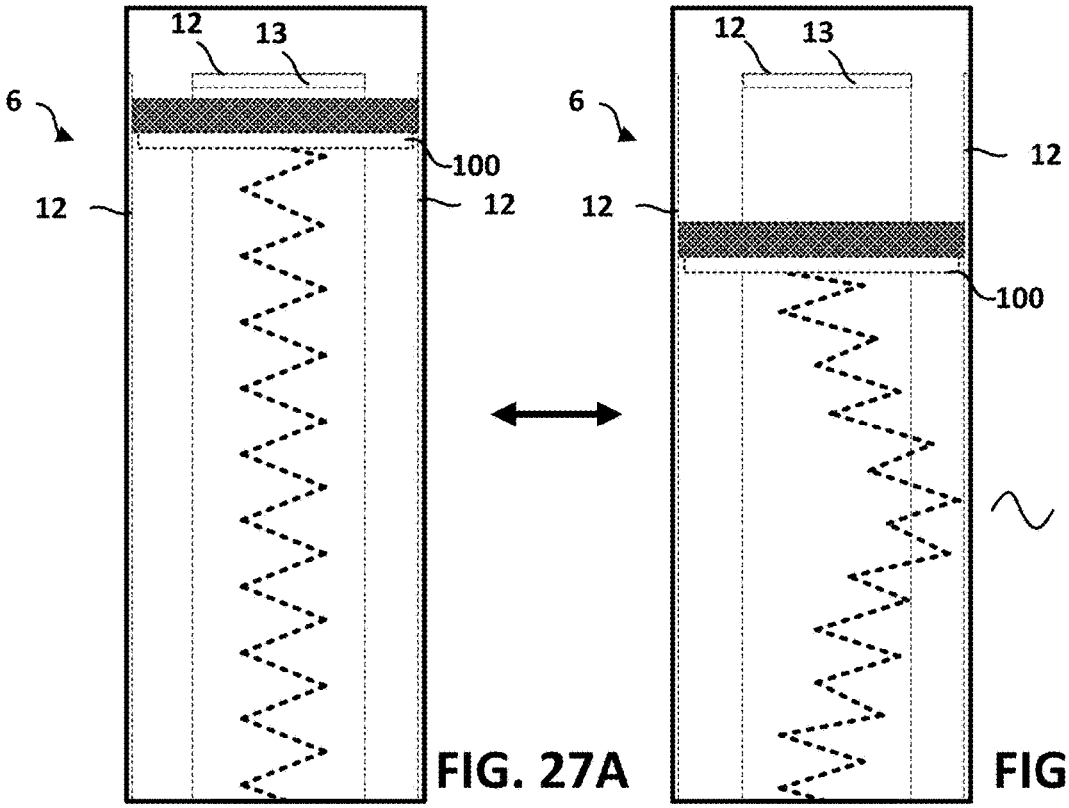
FIG. 27A
FIG. 27B
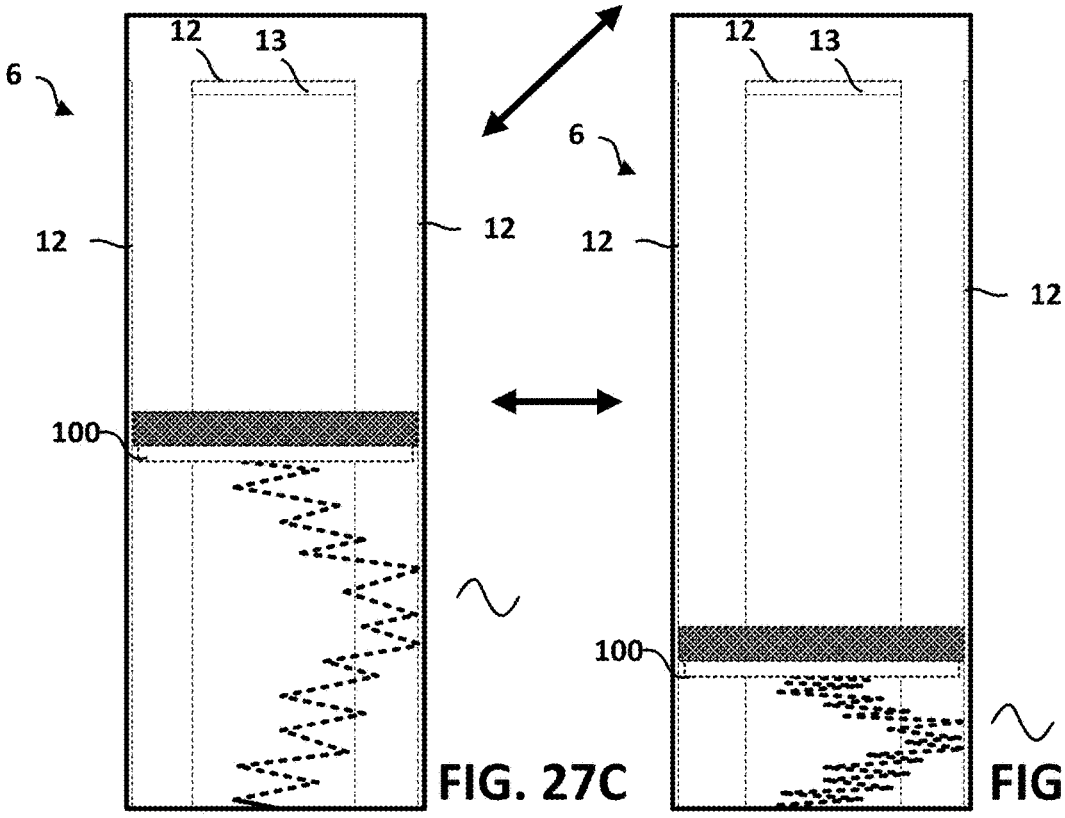
FIG. 27C
FIG. 27D

SPRUNG DISPENSING TOWER WITH RESILIENTLY COMPRESSIBLE SLIDE GUIDE

FIELD OF THE INVENTION

This application relates generally to retail product displays, and more particularly to sprung dispensing towers.

BACKGROUND OF THE INVENTION

A sprung display case is a product storage container inside of which multiple identical or similar products can be stacked, with the stack being spring biased towards an opening to enable a customer to grasp the topmost or outermost of the stacked products. When the customer takes a product from the stack via the opening, the accordingly shortened stack of products is urged under spring bias towards the opening so that the next product in the stack can thereafter be easily grasped. Conversely, when a product is added to the stack via the opening, the accordingly lengthened stack of products urges against the spring bias so that the stack can be accommodated within the case while the topmost or outermost product in the stack is easily grasped.

A sprung dispensing tower is an example of a sprung display case with a housing for containing a vertical stack of products and for always enabling the topmost product in the stack to be dispensed to a customer at a comfortable height at the top of the housing. Various kinds of sprung dispensing towers are available, and each may be configured with dimensions and spring parameters for storing and dispensing various respective kinds of products such as newspapers, dinner plates, and beverage multi-packs.

While various kinds of sprung dispensing towers are available for use with various kinds of products, improvements in their safeness, reliability, and aesthetic impact are desirable.

SUMMARY OF THE INVENTION

In accordance with an aspect of the following, there is provided a sprung dispensing tower comprising a vertical housing having an open top and an interior dimensioned to receive products in a vertical stacked relationship; a platform within the interior of the vertical housing, the platform having a horizontal component and platform sidewalls depending from the horizontal component in parallel with respective interior sidewalls of the vertical housing, the platform being vertically slideable within the interior of the vertical housing between an uppermost position and a lowermost position; a compressible spring associated with an underside of the platform and biasing the platform towards the uppermost position; a resiliently compressible slide guide affixed to at least a portion of the platform sidewalls and extending laterally towards the interior sidewalls of the vertical housing; and at least one air passage below the lowermost position and extending through the vertical housing from the interior to an exterior of the vertical housing.

In embodiments, the sprung dispensing tower comprises impact absorbing shielding affixed to interior sidewalls of the vertical housing between the resiliently compressible slide guide and the interior sidewalls of the vertical housing.

In embodiments, the impact absorbing shielding and the resiliently compressible slide guide are different materials.

In embodiments, the resiliently compressible slide guide comprises a fabric and the impact absorbing shielding comprises a thermoplastic.

In embodiments, the resiliently compressible slide guide comprises a fabric.

In embodiments, the fabric comprises felt.

In embodiments, the impact absorbing shielding comprises a thermoplastic.

In embodiments, the thermoplastic is polyethylene terephthalate (PET).

Various embodiments and described and illustrated herein.

BRIEF DESCRIPTION OF THE FIGURES

Embodiments will now be described more fully with reference to the accompanying drawings, in which:

FIG. 3 is a top plan view of the sprung dispensing tower of FIG. 1;

FIG. 4, like FIG. 2, is a magnified top plan view of a portion of the sprung dispensing tower of FIG. 1;

FIG. 5 is a top plan view of a platform of the sprung dispensing tower of FIG. 1, in isolation, according to an embodiment;

FIG. 6 is a front perspective view of the platform of FIG. 5, in isolation;

FIG. 7 is a front perspective view of the platform of FIGS. 5 and 6, to which is affixed a resiliently compressible slide guide, according to an embodiment;

FIG. 8 is a front elevation view of the arrangement of FIG. 7;

FIG. 22 is a front perspective view of a sprung dispensing tower with a resilient compressible slide guide and impact absorbing shielding, according to an alternative embodiment;

FIG. 23 is a magnified top plan view of a portion of the sprung dispensing tower of FIG. 22;

FIGS. 27A to 27D are side partial sectional views of the progressive only partial axial compression with buckling of a compression spring underneath a platform contacting the impact absorbing shielding under progressive load levels on the platform;

DETAILED DESCRIPTION

Figures 1, 2:
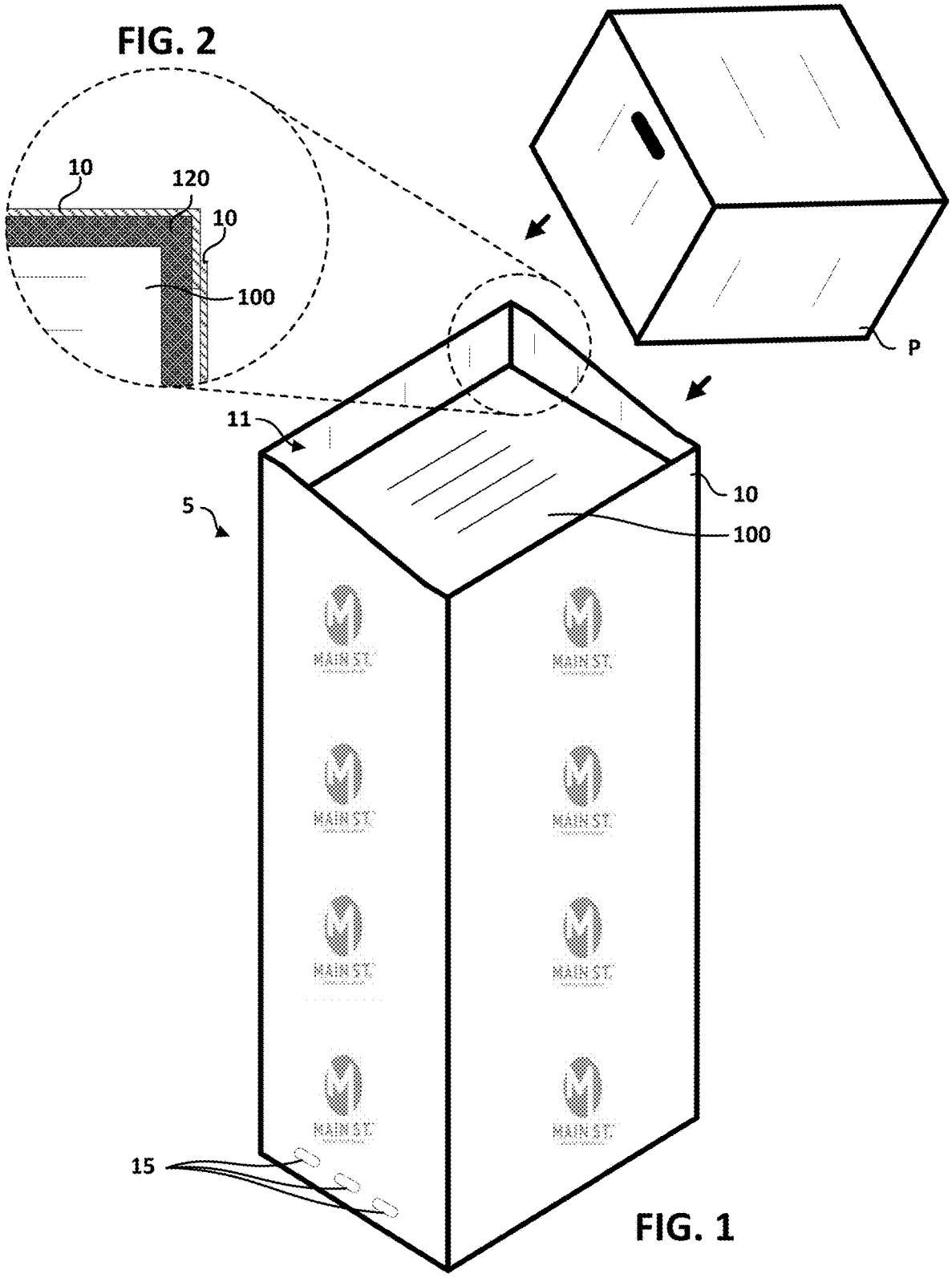
FIG. 1 is a front perspective view of a sprung dispensing tower with a resilient compressible slide guide, according to an embodiment, in which products may be progressively stacked and unstacked.
FIG. 2 is a magnified top plan view of a portion of the sprung dispensing tower of FIG. 1.

FIG. 1 is a front perspective view of a sprung dispensing tower 5, according to an embodiment. Sprung dispensing tower 5 includes a vertical housing 10 with an open top 11 into an interior that is sized and shaped to receive and contain one or more products P in a vertical stacked relationship. In this embodiment, each of products P has a generally rectilinear envelope such as might be common for certain food boxes or beverage multipacks. However, products P may have any form factor and general sturdiness that is amenable to their being progressively vertically stacked atop each other within vertical housing 10 via open top 11, and progressively unstacked via open top 11 by customers.

A platform 100 is disposed within the interior of vertical housing 10 and is vertically slideable within the interior of vertical housing 10 between an uppermost position and a lowermost position. A compressible spring 200 (not shown in FIG. 1) is associated with the underside of platform 100 and biases platform 100 towards the uppermost position. In this embodiment, the uppermost position is the height to which the platform extends when no products are on the platform. Similarly, the lowermost position is the height to which the platform descends when sprung dispensing tower 5 is at its maximum capacity of products P.

In FIG. 1, platform 100 is depicted at its uppermost position ready to receive and support the first of products P being placed atop of it. In this embodiment, multiple air passages 15 extend below the lowermost position from the interior of vertical housing 10 to its exterior.

FIG. 2 is a magnified top plan view of a portion of sprung dispensing tower 5. In this figure, the portion is the top right corner of sprung dispensing tower 5. Affixed to platform 100 about its periphery is a resiliently compressible slide guide 120. Resiliently compressible slide guide 120 extends from platform 100 laterally towards interior-facing (or, simply, interior) sidewalls of vertical housing 10 but is not affixed to the interior sidewalls of vertical housing 10. Rather, while resiliently compressible slide guide 120 may laterally contact portions of the interior sidewalls of vertical housing 10 as shown in FIG. 2, it is slideable with respect to and against the interior sidewalls while sliding with platform 100 between its uppermost and lowermost positions.

In this embodiment, vertical housing 10 and platform 100 are formed of sheet metal. Sheet metal components such as those for sprung dispensing tower 5 are easy to form, and provide structural rigidity, strength and durability.

Resiliently compressible slide guide 120 serves to flexibly guide platform 100 generally centrally within vertical housing 10, and to inhibit metal on metal contact between platform 10 and the interior sidewalls of vertical housing 10. Inhibiting metal on metal contact may provide aesthetic advantages by reducing the noise of banging, clanging and scraping that could occur as products are stacked and unstacked from platform 100, and that could occur while sprung dispensing tower 5 is being moved into position in a retail establishment.

Resiliently compressible slide guide 120 also absorbs impacts by compressing between platform 100 and the interior sidewalls as platform 100 pivots back and forth during stacking and unstacking. In this embodiment, resiliently compressible slide guide 120 is made of one or more layers of fabric such as natural or synthetic felt. For example, resiliently compressible slide guide 120 may be an adhesive-backed polyester felt having a thickness of about 3 mm (0.118"), and a width of about 0.5 inches, adhered to platform 100. Such a material may be sourced from The Felt Company of Madison Heights, Michigan (https://www.thefeltcompant.com/black-felt-stripping-adhesive-backed-1-wide-x-3 mm-118-thick-50-roll-3-roll-minimum/). A felt such as is described above can be compressed but, when released, may generally tend to expand to its original thickness thereby to enable it to again absorb impact from a subsequent compression. Alternatives are possible.

It will be appreciated that controlling the pivoting of platform 100 with respect to the interior sidewalls to reduce banging, clanging and scraping may otherwise or additionally be attempted by controlling the attributes of compression spring 200 and its association to platform 100. For example, a stiffer compression spring may somewhat inhibit pivoting or tipping of platform 100 towards the interior sidewalls by behaving, in this respect, a little more like a stiff vertical post than would a more flexible spring. However, in the tower configuration the compression spring would be long enough to serve, with platform 100, as a lever with a large moment about a point at the bottom of housing 10 to which the compression spring would be fixed. That is, the length of compression spring in the tower configuration would work significantly against its stiffness in respect of keeping the platform from banging into the interior sidewalls, particularly under the influence of significant product weight from above. Furthermore, increasing the compression spring stiffness may reduce its compressibility, and may therefore constrain the sprung dispensing tower to dispensing only products that are very heavy. Still further, it may be difficult to cost-effectively mass-manufacture large numbers of sprung dispensing towers each with platforms that do not contact interior sidewalls by only controlling for compression spring stiffness. As such, resiliently compressible slide guide 120 can be a very cost-effective, reliable and aesthetically-pleasing approach to guiding platform 100, adapting to larger manufacturing tolerances (such as wide variances in sizes of gaps between platform 100 and interior sidewalls), and reducing noise.

FIG. 3 is a top plan view of sprung dispensing tower 5, and FIG. 4, like FIG. 2, is a magnified top plan view of a portion of sprung dispensing tower 5.

FIG. 5 is a top plan view of platform 100 of sprung dispensing tower 5 in isolation, and FIG. 6 is a front perspective view of platform 100 in isolation, according to an embodiment. Platform 100 includes a horizontal component 102 that generally faces open top 11 of vertical housing 10 when platform 100 is received within the interior of vertical housing 10. While in this embodiment horizontal component 102 is a uniform, planar surface, in other embodiments a horizontal component is not required to itself be uniformly horizontal. For example, a horizontal component of a platform may be slightly corrugated, may be a series of uniform-height posts, or may have a rough surface of the texture of sandpaper. Therefore, in this description, reference to a horizontal component of the platform refers to the platform providing structure to enable a product resting atop of the horizontal component to be supported in a generally horizontal manner so that it may be generally vertically stacked with other products atop of the horizontal component.

In this embodiment, four platform sidewalls 104A, 104B, 104C and 104D depend rigidly from horizontal component 102 away from open top 11 and extend substantially in parallel with respective interior sidewalls of vertical housing 10. Because platform sidewalls 104A-104D extend substantially in parallel with respective interior sidewalls past which they will slide, by their interaction with the interior sidewalls (via resiliently compressible slide guide 120 as will be shown) they will enable platform to remain generally horizontal even under the influence of uneven pressures from above platform 100. For example, if a product P is unevenly placed on, or lifted from, horizontal component 102 of platform 100, platform 100 will tend to tip off-horizontal. Platform sidewalls 104A-104D in this situation will, via resiliently compressible slide guide 120, press against the interior sidewalls of housing 10 to thereby inhibit platform 100 from tipping very far off-horizontal.

FIG. 7 is a front perspective view of platform 100, to which is affixed resiliently compressible slide guide 120, according to an embodiment. In this embodiment, resiliently compressible slide guide 120 is affixed to each of platform sidewalls 104A-104D and extends laterally outwards. FIG. 8 is a front elevation view of the arrangement of FIG. 7.

Figure 9:
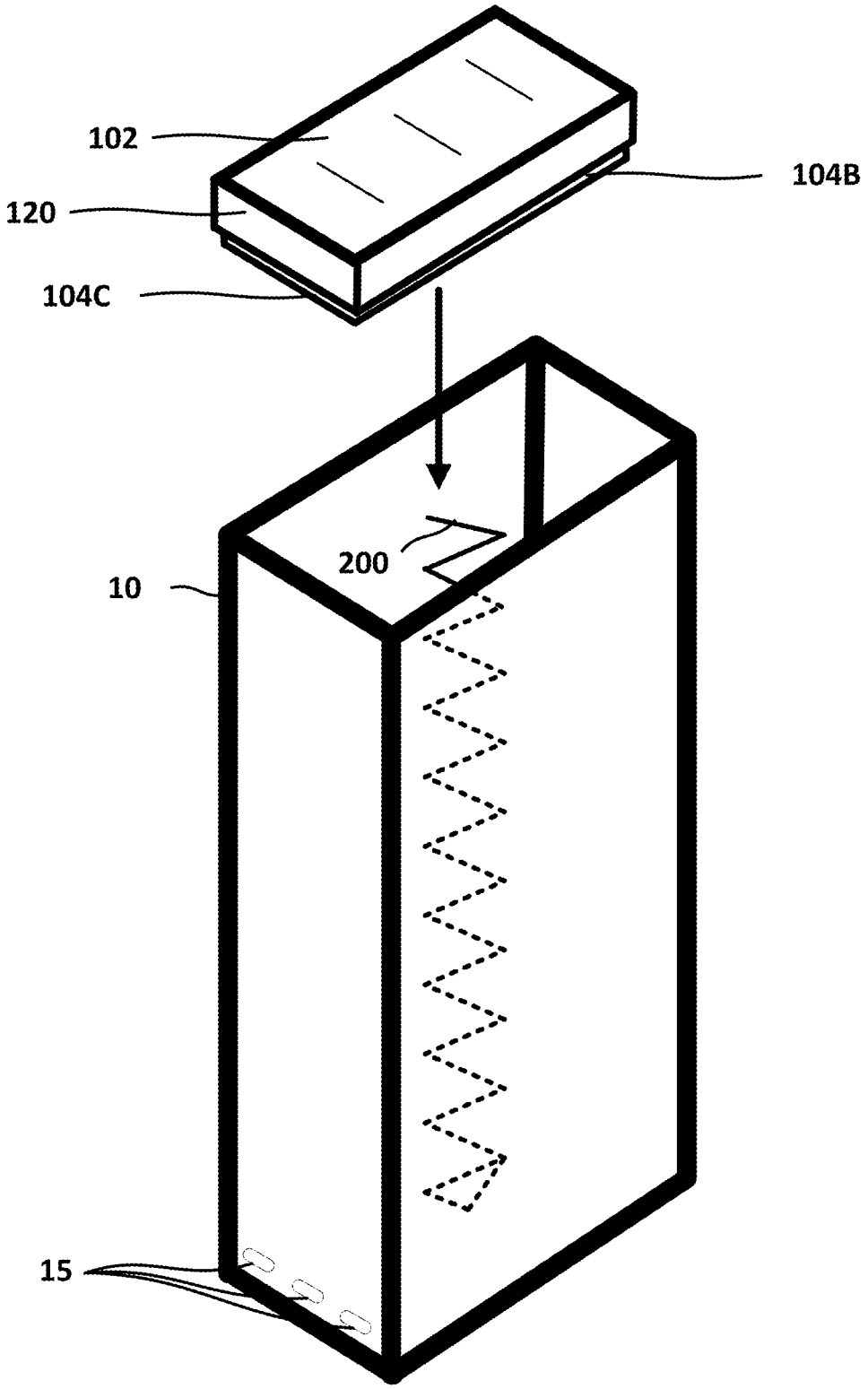
FIG. 9 is an exploded front perspective view of the arrangement of FIG. 7 being inserted into housing of the sprung dispensing tower atop a compressible coil spring that is itself affixed within the housing.

FIG. 9 is an exploded front perspective view of the arrangement of FIG. 7 being inserted during assembly of sprung dispensing tower 5 into the interior of housing 10 atop a compressible coil spring 200 that is itself affixed within housing 10.

The arrangement of FIG. 7 features the top of resiliently compressible slide guide 120 being about flush or only just below flush with horizontal component 102 of platform 100. Furthermore, resiliently compressible slide guide 120 is affixed about the entire periphery of platform 100. Each of these aspects provides a nicely finished or complete look, but also provides useful functionality. In particular, the flush or just below flush arrangement reduces the chance of contact by products P with the resiliently compressible slide guide 120 that might otherwise occur were resiliently compressible slide guide 120 to be above flush. This may preserve the longevity of resiliently compressible slide guide 120. Furthermore, the flush or just below flush arrangement, in combination with the resiliently compressible slide guide 120 extending around the entire periphery of platform 100 may reduce the chance that a customer's dropped personal effects such as loose change could fall into a gap between platform 100 and interior sidewalls of vertical housing 10 while the customer is grasping a product P from the stack.

Still further, the resiliently compressible slide guide 120 extending around the entire periphery of platform 100 may advantageously serve to reduce the amount of airflow streaming through open top 11 into and out of the interior of vertical housing 10 as products are stacked and unstacked. Air passages 15 as depicted herein may compensate for this to provide necessary air flow conditions while also channeling airflow to and from the interior of vertical housing 10 away from open top 11. It will be appreciated that customers who take products P from sprung dispensing tower 5, and personnel who load and re-load sprung dispensing tower 5 with such products P, are each doing so while facing open top 11. Using the combination of a resiliently compressible slide guide 120 that extends around the entire periphery of platform 100 and one or more air passages such as air passages 15 that are not near to or directed at such users' faces, may serve to keep as much of the necessary airflow as possible away from users' faces. To aid with this, platform 100 itself has no holes extending through it from the interior side to the exterior side of platform 100.

However, various alternative configurations of resiliently compressible slide guide, and arrangements of resiliently compressible slide guide with respect to platform 100, may be deployed.

Figure 10:
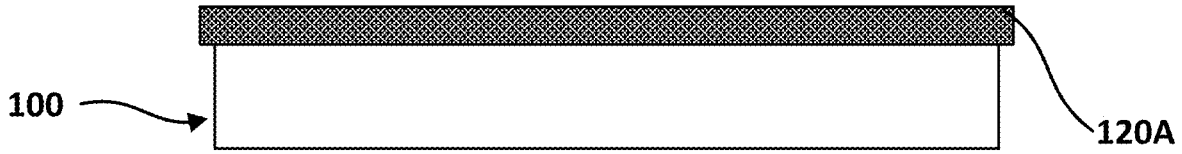
FIG. 10 is a front elevation view of the platform of FIG. 5 to which is affixed a resiliently compressible slide guide, according to an alternative embodiment.

For example, FIG. 10 is a front elevation view of platform 100 to which is affixed a resiliently compressible slide guide 120A, according to an alternative embodiment. Resiliently compressible slide guide 120A is thinner than resiliently compressible slide guide 120 but, like resiliently compressible slide guide 120, extends around the entire periphery of platform 100 and has a top surface that is flush or just below flush with horizontal component 102 of platform 100.

Figure 11:
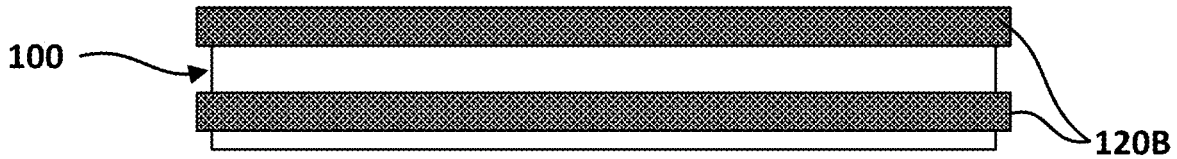
FIG. 11 is a front elevation view of the platform of FIG. 5 to which is affixed a resiliently compressible slide guide, according to another alternative embodiment.

FIG. 11 is a front elevation view of platform 100 to which is affixed a resiliently compressible slide guide 120B, according to another alternative embodiment. In this embodiment resiliently compressible slide guide 120B is formed of two thinner strips that each extend around the entire periphery of platform 100. The topmost of the two strips has a top surface that is flush or just below flush with horizontal component 102 of platform 100.

Figure 12:
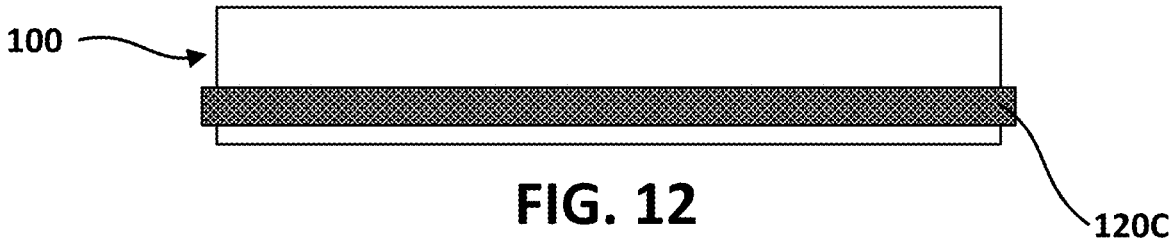
FIG. 12 is a front elevation view of the platform of FIG. 5 to which is affixed a resiliently compressible slide guide, according to another alternative embodiment.

FIG. 12 is a front elevation view of platform 100 to which is affixed a resiliently compressible slide guide 120C, according to another alternative embodiment. Resiliently compressible slide guide 120C is thinner than resiliently compressible slide guide 120 but, like resiliently compressible slide guide 120, extends around the entire periphery of platform 100. However, resiliently compressible slide guide 120C has a top surface that is substantially below flush with horizontal component 102 of platform 100.

Figure 13:
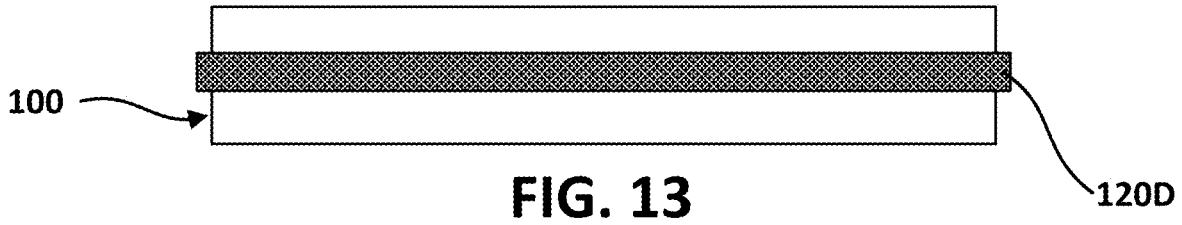
FIG. 13 is a front elevation view of the platform of FIG. 5 to which is affixed a resiliently compressible slide guide, according to another alternative embodiment.

FIG. 13 is a front elevation view of platform 100 to which is affixed a resiliently compressible slide guide 120D, according to another alternative embodiment. Resiliently compressible slide guide 120D is thinner than resiliently compressible slide guide 120 but, like resiliently compressible slide guide 120, extends around the entire periphery of platform 100. However, resiliently compressible slide guide 120C has a top surface that is somewhat below flush with horizontal component 102 of platform 100.

Figure 14:
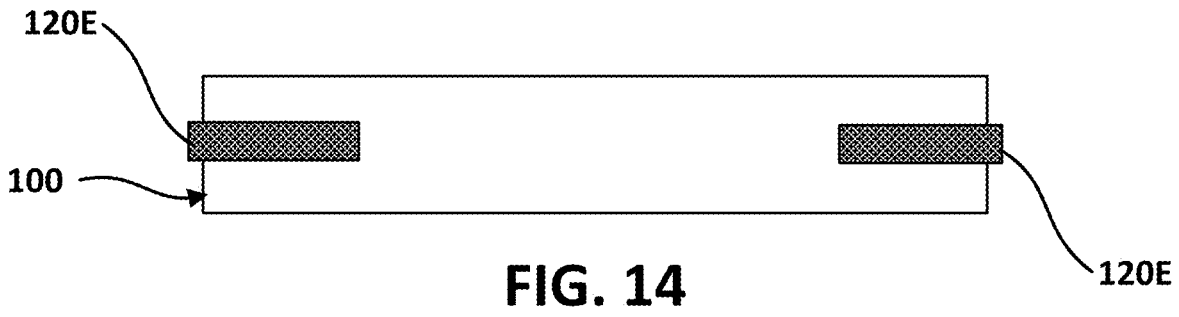
FIG. 14 is a front elevation view of the platform of FIG. 5 to which is affixed a resiliently compressible slide guide, according to another alternative embodiment.
Figure 15:
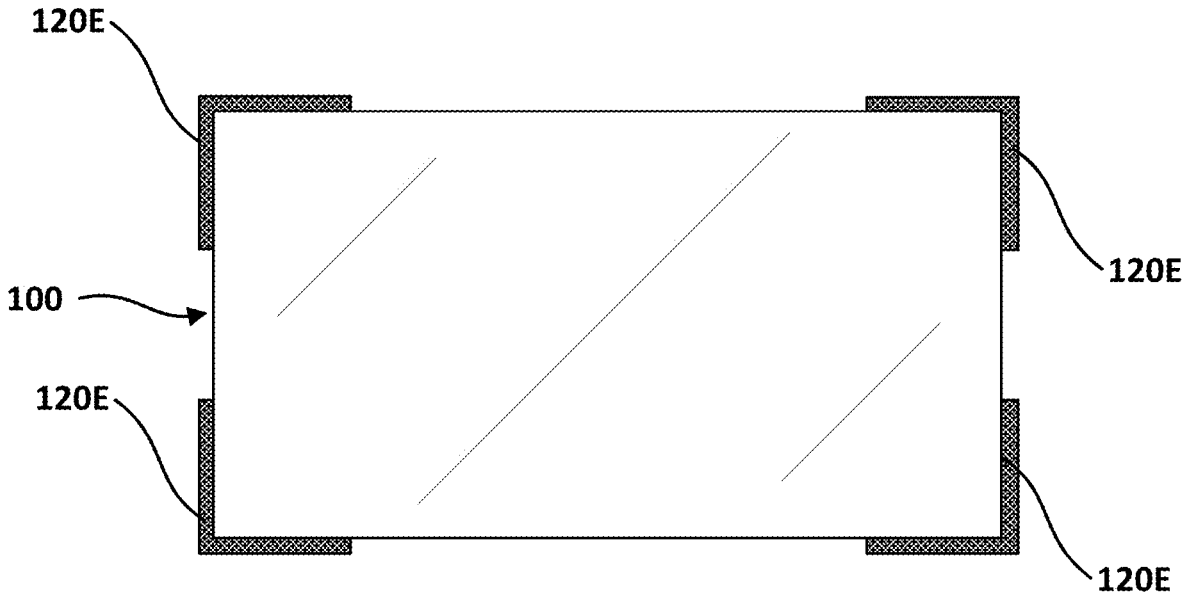
FIG. 15 is a top plan view of the arrangement of FIG. 14.

FIG. 14 is a front elevation view of platform 100 to which is affixed a resiliently compressible slide guide 120E, according to another alternative embodiment. FIG. 15 is a top plan view of the arrangement of FIG. 14. Resiliently compressible slide guide 120E is thinner than resiliently compressible slide guide 120 and is formed in four separate parts and thus, unlike resiliently compressible slide guide 120, does not extends around the entire periphery of platform 100. Furthermore, resiliently compressible slide guide 120E has a top surface that is somewhat below flush with horizontal component 102 of platform 100.

Figure 16:
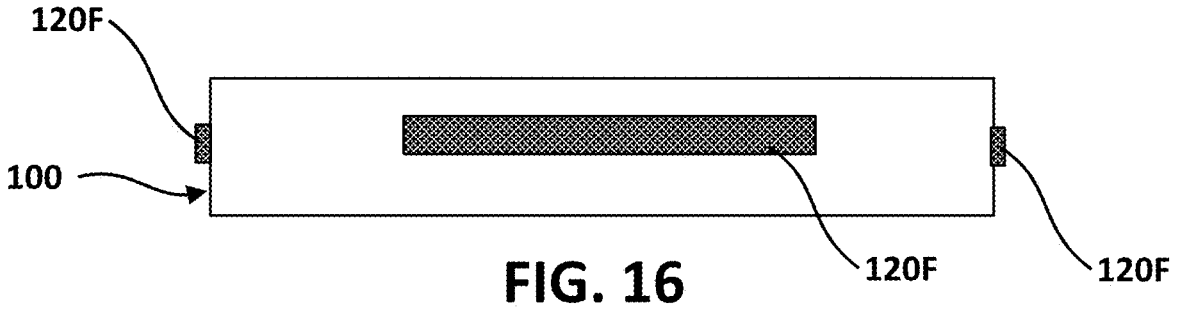
FIG. 16 is a front elevation view of the platform of FIG. 5 to which is affixed a resiliently compressible slide guide, according to another alternative embodiment.
Figure 17:
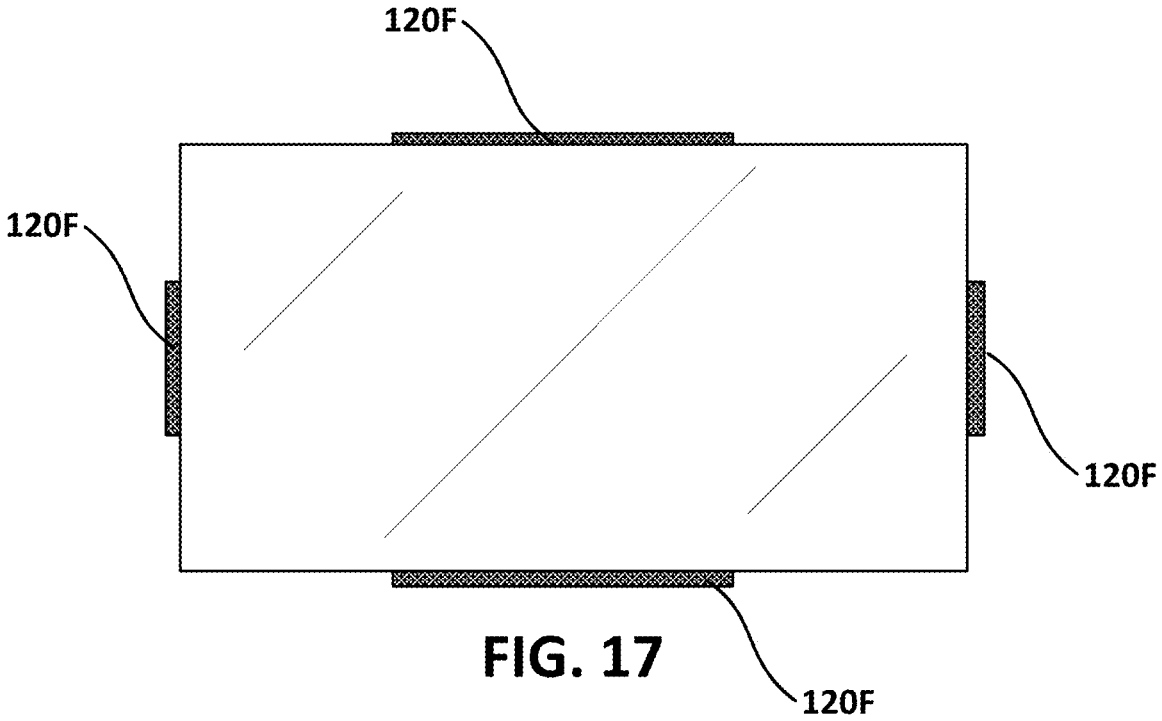
FIG. 17 is a top plan view of the arrangement of FIG. 16.

FIG. 16 is a front elevation view of platform 100 to which is affixed a resiliently compressible slide guide 120F, according to another alternative embodiment. FIG. 17 is a top plan view of the arrangement of FIG. 16. Resiliently compressible slide guide 120F is thinner than resiliently compressible slide guide 120 and is formed in four separate parts and thus, unlike resiliently compressible slide guide 120, does not extends around the entire periphery of platform 100. Furthermore, resiliently compressible slide guide 120F has a top surface that is somewhat below flush with horizontal component 102 of platform 100.

Figure 18:
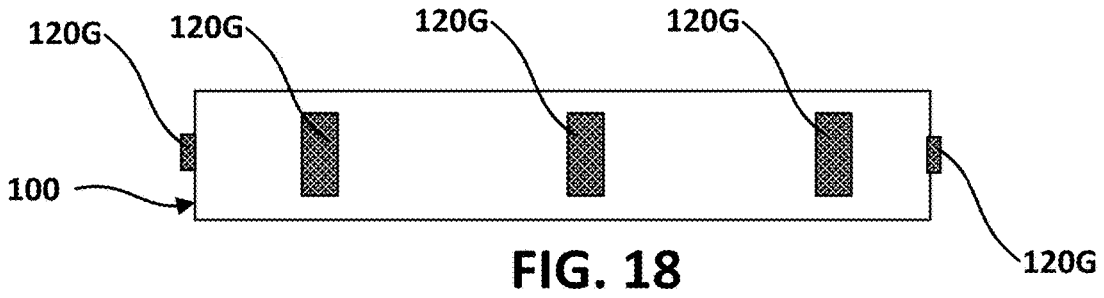
FIG. 18 is a front elevation view of the platform of FIG. 5 to which is affixed a resiliently compressible slide guide, according to another alternative embodiment.
Figure 19:
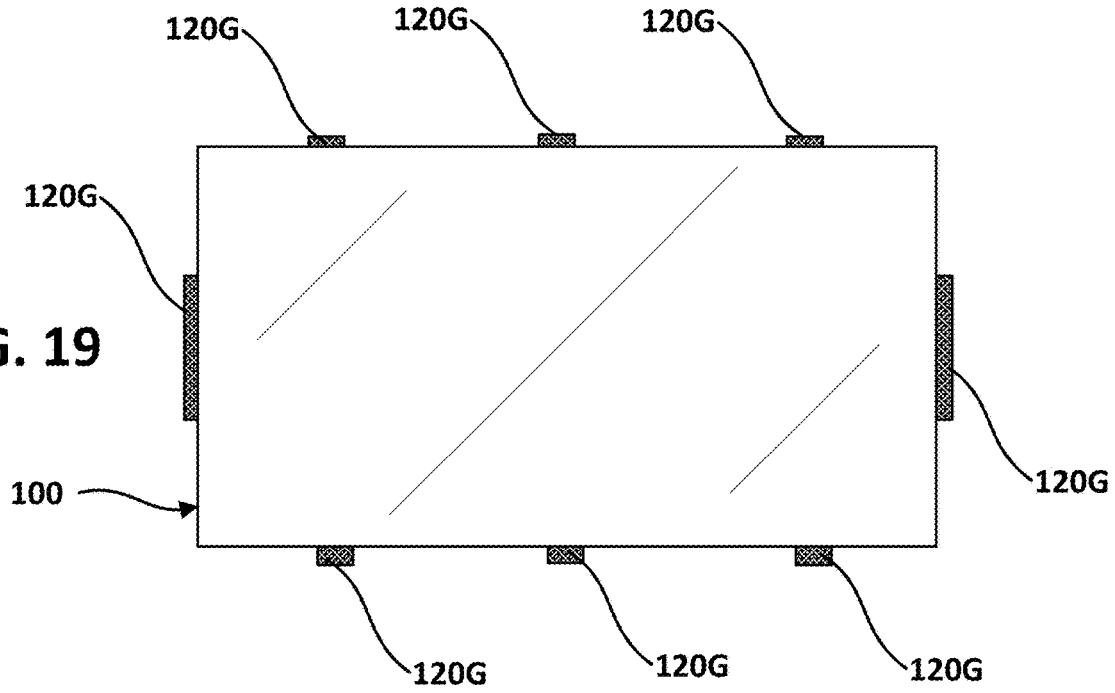
FIG. 19 is a top plan view of the arrangement of FIG. 18.
Figure 20A:
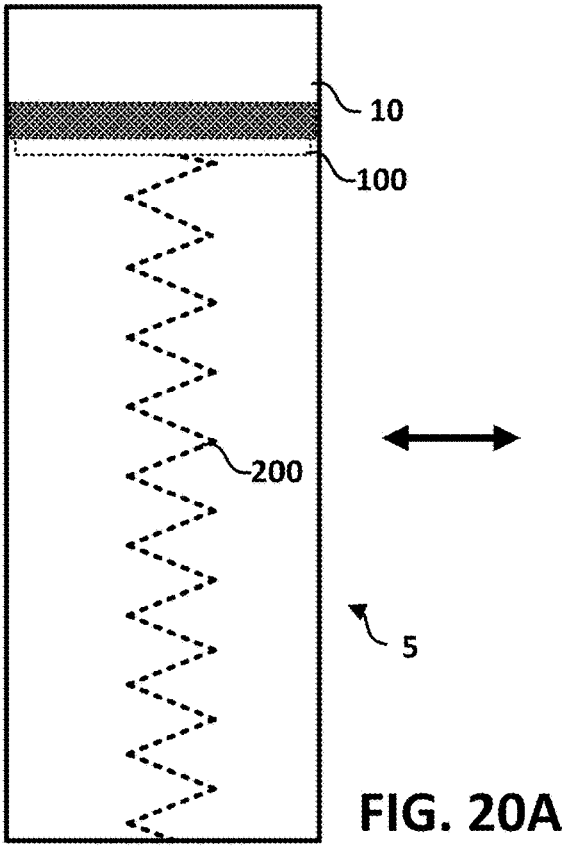
FIGS. 20A to 20D are side partial sectional views of the progressive substantially axial compression of a compression spring underneath a platform under progressive load levels on the platform.
Figure 20B:
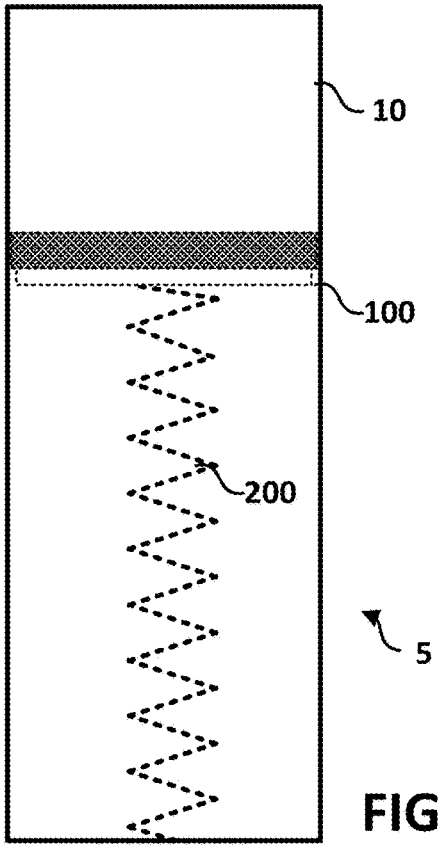
Figure 20C:
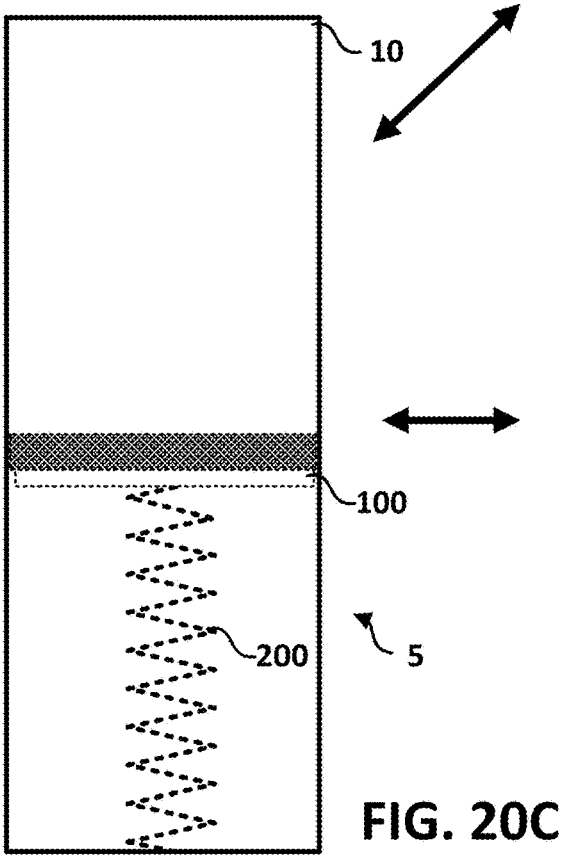
Figure 20D:
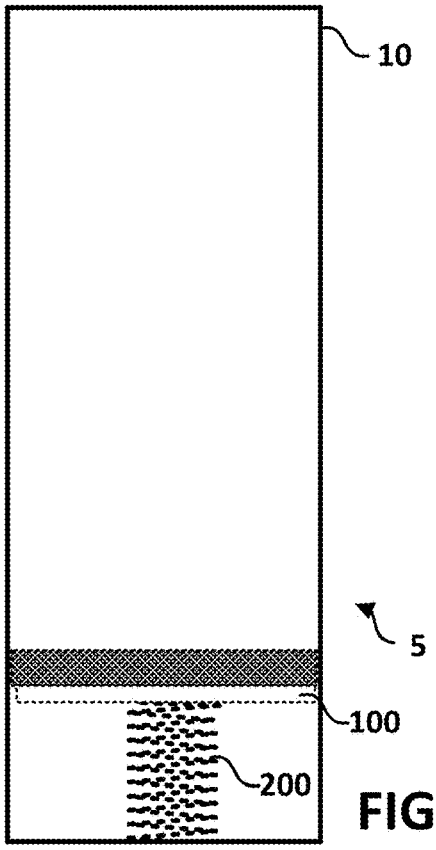
Figure 21A:
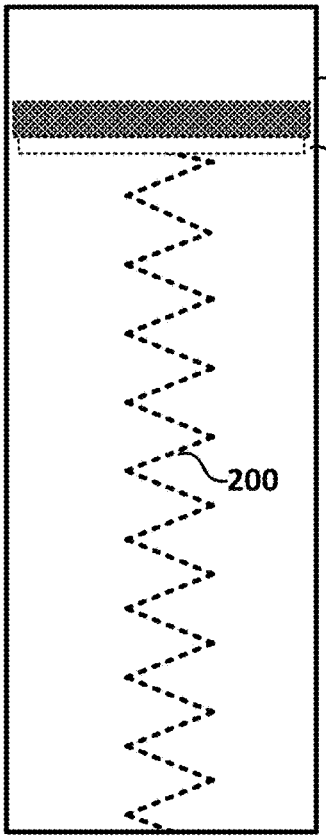
FIGS. 21A to 21D are side partial sectional views of the progressive only partial axial compression with buckling of a compression spring underneath a platform contacting the interior sidewalls of the housing under progressive load levels on the platform.
Figure 21B:
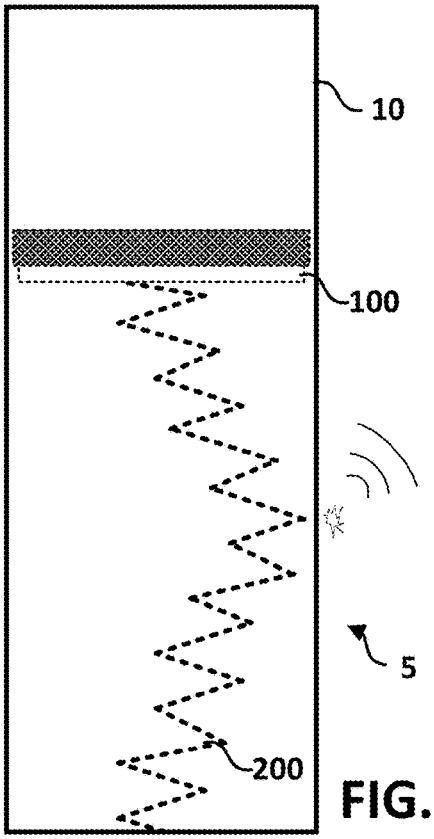
Figure 21C:
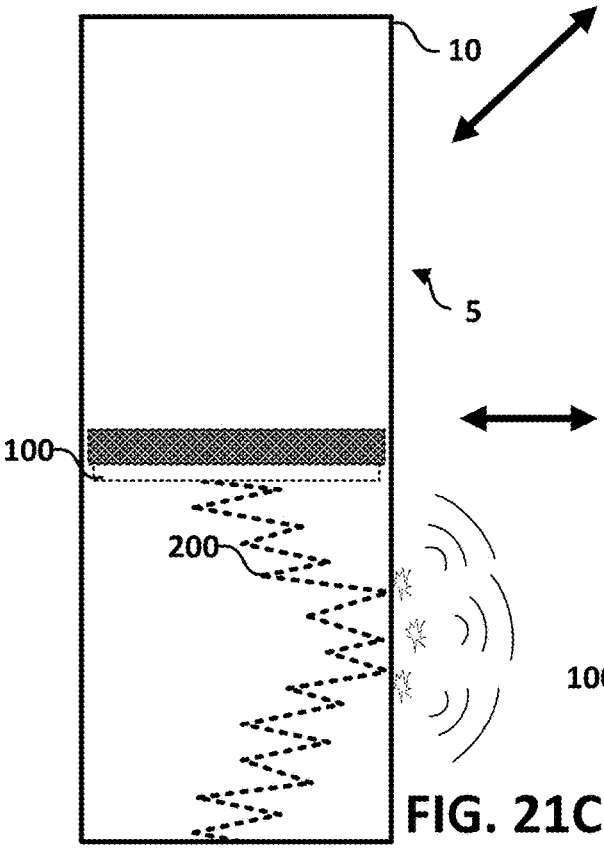
Figure 21D:
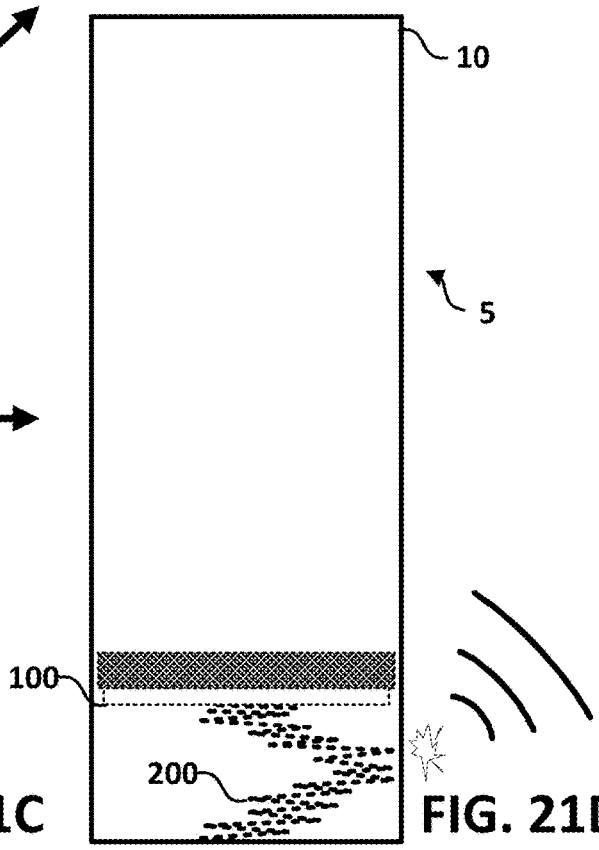

FIG. 18 is a front elevation view of platform 100 to which is affixed a resiliently compressible slide guide 120G, according to another alternative embodiment. FIG. 19 is a top plan view of the arrangement of FIG. 18. Resiliently compressible slide guide 120G is thinner than resiliently compressible slide guide 120 and is formed in eight separate parts and thus, unlike resiliently compressible slide guide 120, does not extends around the entire periphery of platform 100. Furthermore, parts of resiliently compressible slide guide 120G have top surfaces that are somewhat more or less below flush with horizontal component 102 of platform 100.

FIGS. 20A to 20D are side partial sectional views of the progressive substantially axial compression of a compression spring underneath a platform 100 of a sprung dispensing tower 5 under progressive load levels on platform. These figures depict a somewhat ideal axial compression of a compression spring with no buckling. While arrangements with a compression spring and platform that do not cause a compression spring to buckle under load are certainly possible and desirable, in a mass-manufacturing context it becomes more and more challenging and accordingly expensive to assemble large numbers of sprung dispensing towers, none of which exhibit any spring buckling whatsoever. Also, for platforms such as platform 100 having a length that is greater than its width, differential downward pressures onto the platform 100 or leveraged pressure from one direction that is farther from the centre of platform 100 than is achievable from another may cause differential pressure against the top of the compression spring, possibly influencing buckling. It can be very expensive to prevent such differential pressures from influencing the compression spring itself towards buckling.

With a view to addressing this, it has been discovered that a degree of spring buckling may actually be permitted in a sprung dispensing tower without unduly inhibiting functionality, durability or longevity of the compression spring or other components of the sprung dispensing tower.

However, permitting a degree of spring buckling may result in portions of the spring coming into contact with, and scraping against, the interior sidewall of housing during upward and downward movement of platform 100, as shown in FIGS. 21A to 21D. These figures are side partial sectional views of the progressive only partial axial compression, with buckling, of a compression spring 200 underneath platform 100 contacting the interior sidewalls of housing 10 of sprung dispensing tower 5 under progressive load levels on the platform 100. As spring 200 is compressed it may buckle as shown and bang and/or scrape against the interior sidewall.

Figures 24, 25:
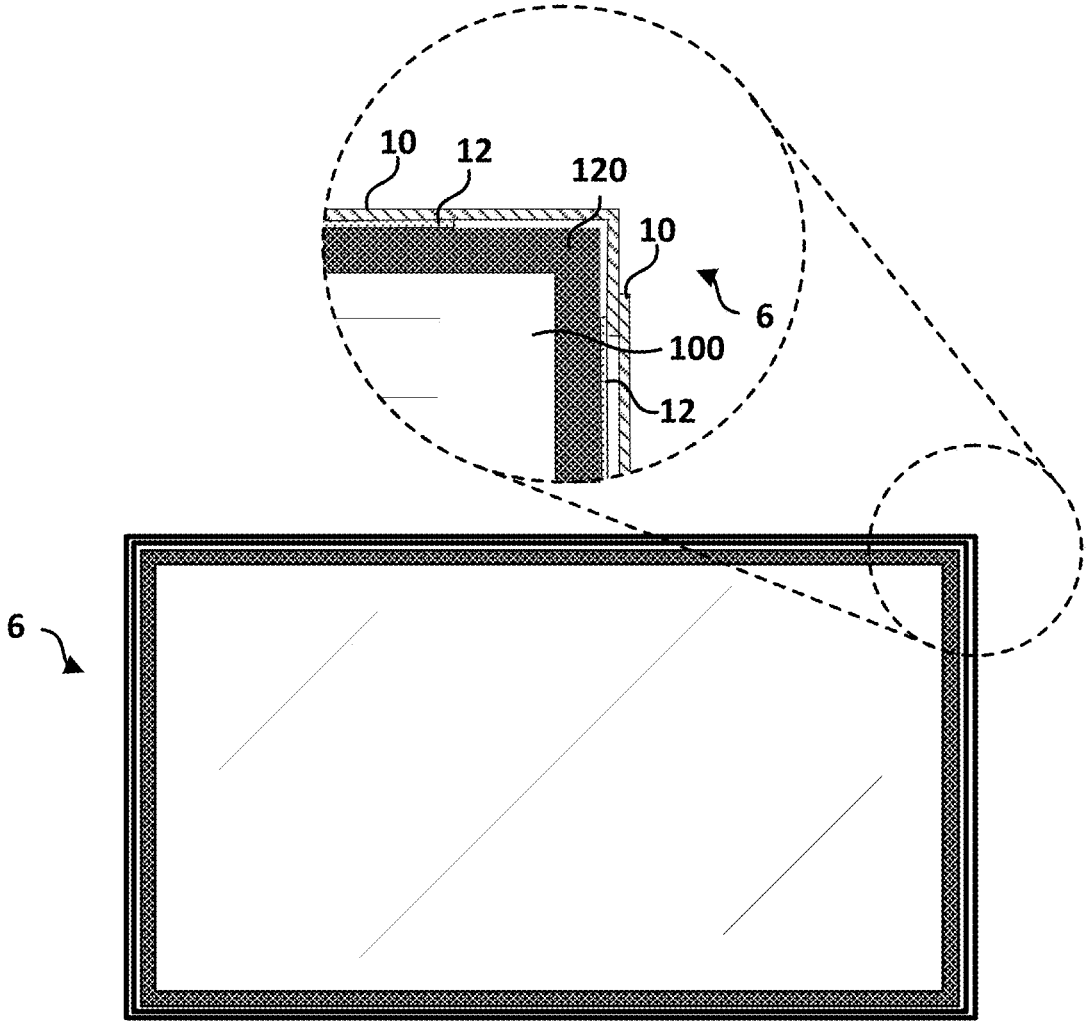
FIG. 24 is a top plan view of the sprung dispensing tower of FIG. 22.
FIG. 25, like FIG. 23, is a magnified top plan view of a portion of the sprung dispensing tower of FIG. 22.

In order to permit buckling of a compression spring 200, as may happen in particular individual sprung dispensing towers, while inhibiting the intensity and/or modifying the acoustic pitch or combination of acoustic pitches resulting from any such buckling causing spring 200 contacting the interior sidewalls of housing 10, an impact absorbing shielding 12 may be affixed to the interior sidewalls. FIG. 22 is a front perspective view of a sprung dispensing tower 6 with a resilient compressible slide guide 120 and impact absorbing shielding 12, according to an alternative embodiment. FIG. 23 is a magnified top plan view of a portion of sprung dispensing tower 6. Sprung dispensing tower 6 is similar to sprung dispensing tower 5, except that strips of the impact absorbing shielding 12 are affixed to respective interior sidewalls of housing 10 between resilient compressible slide guide 120 and housing 10. It will be appreciated that, in this embodiment, the strips of impact absorbing shielding 12 do not extend the whole width of a respective interior sidewall of housing 10; as their function is to shield the interior sidewalls of housing 10 from contact with spring 200, impact absorbing shielding 12 does not need to be positioned along a respective interior sidewall of housing 10 that spring 200 could not—due to its circumference—reach. However, wider strips of impact absorbing shielding 12 on each interior sidewall could be used. FIG. 24 is a top plan view of sprung dispensing tower 6, and FIG. 25, like FIG. 23, is a magnified top plan view of a portion of sprung dispensing tower 6.

Figure 26:
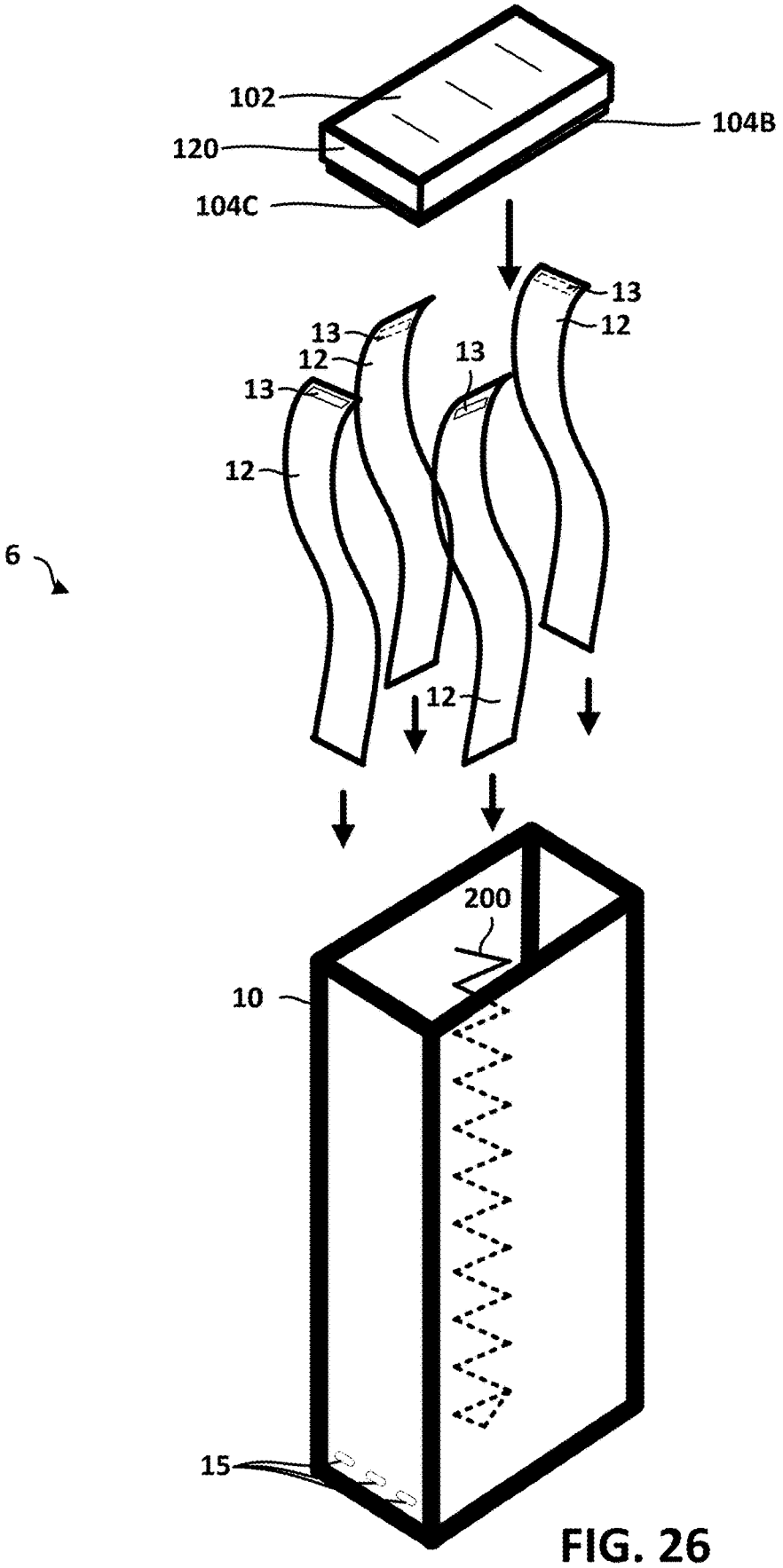
FIG. 26 is an exploded front perspective view of the arrangement of FIG. 7 being inserted atop a compressible coil spring that is affixed within the housing and between impact absorbing shielding which is, in turn, inserted into the housing.
Figure 28A:
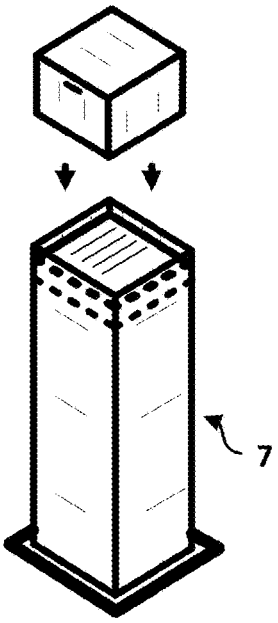
FIGS. 28A to 28F are front perspective views of an alternative form factor of sprung dispensing tower showing progressive stacking of products into a housing supported by a sprung platform.
Figure 28B:
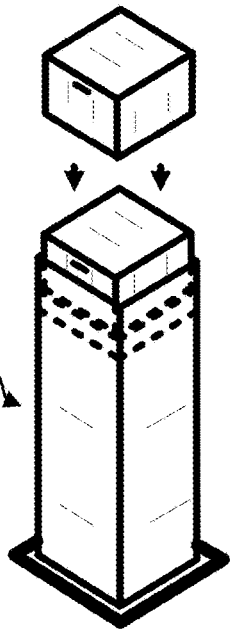
Figure 28C:
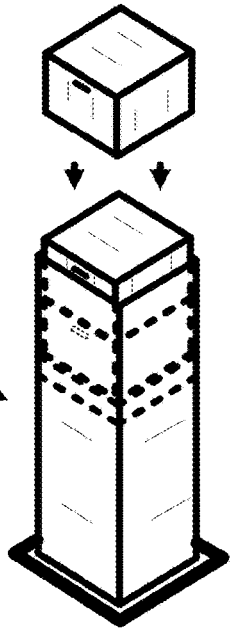
Figure 28D:
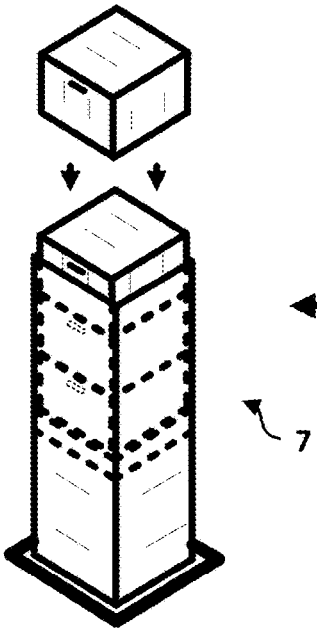
Figure 28E:
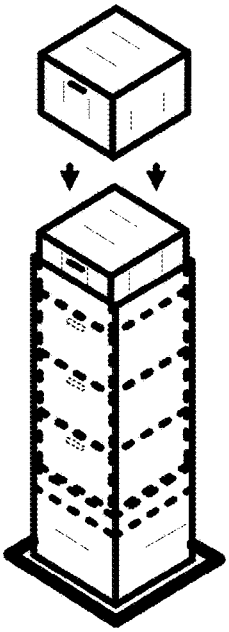
Figure 28F:
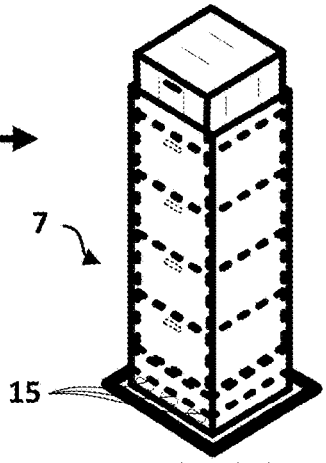
Figure 29A:
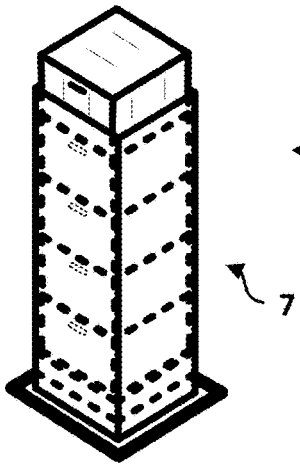
FIGS. 29A to 29F are front perspective views of the alternative form factor of sprung dispensing tower of FIGS. 28A to 28F, showing progressive unstacking of products from the housing.
Figure 29B:
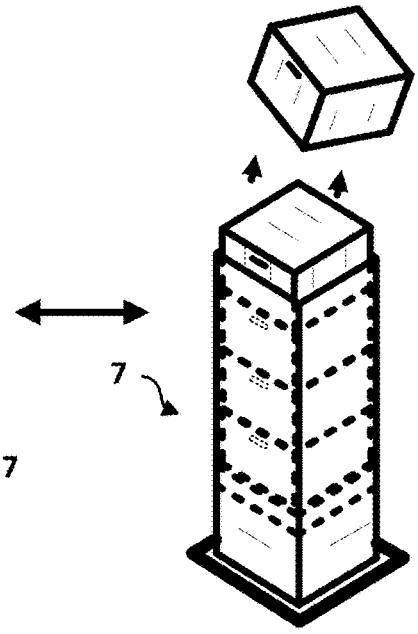
Figure 29C:
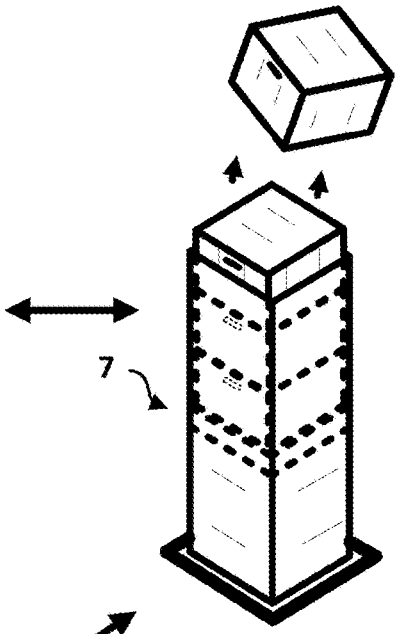
Figure 29D:
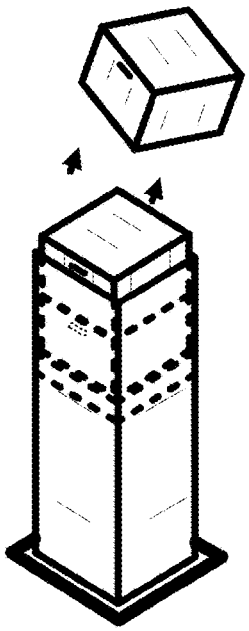
Figure 29E:
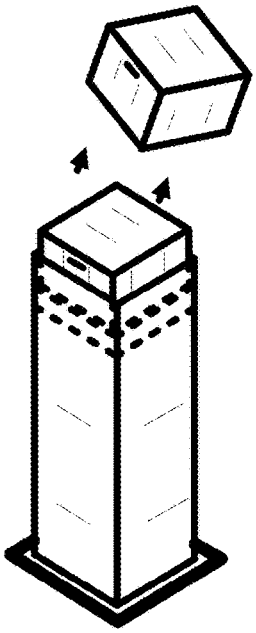
Figure 29F:
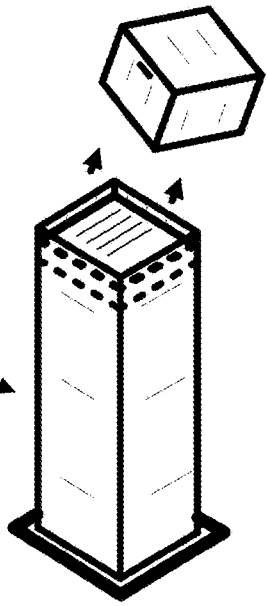

In this embodiment, each strip of impact absorbing shielding 12 is made of a 12 pt clear polyethylene terephthalate (PET). Other thermoplastic materials, and/or other kinds of materials may be used as an alternative to PET, for absorbing impacts from spring 200. As will be appreciated, the PET material is somewhat flexible such that it can be removed from a roll for installation, and is somewhat compressible to absorb energy from a contact with a spring 200 rather than enable all of the energy to be transmitted directly to housing 10. In order to affix a strip of impact absorbing shielding 12 to a respective interior sidewall of housing 10, strips of double-sided tape 13 may be adhered to both an exterior-facing side of the strip of impact absorbing shielding 12 and an upper part of a respective the interior sidewall of housing 10. FIG. 26 is an exploded front perspective view of the arrangement of FIG. 7 being inserted atop a compressible coil spring that is affixed within the housing and between strips of impact absorbing shielding 12 which is, in turn, adhered to a respective interior sidewall of housing 10 using strips of double-sided tape 13. The strips of impact absorbing shielding 12 are shown as somewhat non-planar simply for ease of understanding, but it will be understood that platform 100, through resiliently-compressible slide guide 120, will tend to flatten impact absorbing shielding 12 against respective interior sidewalls of housing 10 as platform 100 slides up and down within the interior of housing 10. In embodiments, multiple strips of double-sided tape or other adhesive may be applied along the top-to-bottom length of a respective strip of impact absorbing shielding 12. Alternatives are possible.

FIGS. 27A to 27D are side partial sectional views of the progressive only partial axial compression with buckling of a compression spring 200 underneath platform 100 contacting the impact absorbing shielding 12 under progressive load levels on platform 100. In contrast with the potentially sharp and dramatic acoustic effect of spring contact shown in, and described above in connection with, FIGS. 21A to 21D, the acoustic effect of spring contact with impact absorbing shielding 12 is generally likely to be more muted and accordingly less dramatic. As such, while buckling of spring 200 may occur during compression of spring 200, its acoustic effect may be more aesthetically pleasing or may even be unnoticeable to the typical customer.

FIGS. 28A to 28F are front perspective views of an alternative form factor of sprung dispensing tower 7 showing progressive stacking of products into a housing supported by a sprung platform. FIGS. 29A to 29F are front perspective views of the sprung dispensing tower 7, showing progressive unstacking of products from the housing. The compression sprung associated with the underside of the platform is not shown in these figures for simplicity. The products inside of the housing, as well as the sprung platform on which they are stacked, are shown using dashed lines. It will be appreciated that—for example—a stack of three products in the housing may be added to (typically, by personnel in retail establishment), to make a stack of four products in the housing that accordingly pushes the platform downward, or removed from (typically, by customers in a retail establishment), to leave a stack of two products in the housing that is pushed via the platform upward. In the embodiment shown in these figures, the housing can accommodate a stack of five products, such as five beverage multipacks. It will be appreciated that greater or fewer products may be accommodated within a housing of a sprung dispensing tower, and that the spring attributes are selected to accord with the weight of the products.

While embodiments have been described, alternatives are possible.

For example, in embodiments, a flexible tether may extend from a bottom of the vertical housing to a bottom of the platform, for preventing the platform from being urged beyond the top of the vertical housing by the compression spring. Such a tether may be a chain or some other component.

Furthermore, while in embodiments the resiliently compressible slide guide is affixed to and moves with the platform, alternatives are possible in which strips of a resiliently compressible slide guide made of, for example, felt, are affixed to respective interior sidewalls such that the platform moves with respect to the resiliently compressible slide guide. In such an example, the resiliently compressible slide guide could serve also as impact absorbing shielding.

In embodiments, multiple layers of the same and/or different materials as have been described herein, and not just single such layers, may be employed as resiliently compressible slide guide and/or impact absorbing shielding. For example, a thin PET layer might be affixed about the periphery of a platform to be intermediate a resiliently compressible slide guide material of felt, so as to garner the benefits of the resilient compressibility of the felt while enabling the thin PET layer to protect the felt itself from being progressively pulled at or torn over many cycles of rigorous use. Similarly, the impact absorbing shield may include, for example, a layer of felt intermediate a layer of PET and the interior sidewalls of the housing, to increase the impact absorption qualities using the felt behind the PET.

While particular form factors of housing, and particular capacities of housing, have been shown and described herein, alternatives are possible. For example, the principles described herein may be used with various vertical dispensing towers of various heights and having platforms and housings with various cross-sectional shapes, such as triangular, rectangular, square, pentagonal, hexagonal, octagonal, circular, ovular, and other shapes. Such shapes might be chosen to accord with the shapes of the products to be stored within and dispensed from the housing. In the case of a circular or ovular housing, it may be considered by the person of ordinary skill that a corresponding circular or ovular platform may be regarded as having a single platform sidewall that depends from the platform's horizontal component in parallel with a single respective interior sidewall of the vertical housing.

What is claimed is:

1. A sprung dispensing tower comprising:

a vertical housing having an open top and an interior dimensioned to receive products in a vertical stacked relationship;

a platform within the interior of the vertical housing, the platform having a horizontal component and platform sidewalls depending from the horizontal component in parallel with respective interior sidewalls of the vertical housing, the platform being vertically slideable within the interior of the vertical housing between an uppermost position and a lowermost position;

a compressible spring associated with an underside of the platform and biasing the platform towards the uppermost position;

a resiliently compressible slide guide affixed to at least a portion of the platform sidewalls and extending laterally towards the interior sidewalls of the vertical housing;

at least one air passage below the lowermost position and extending through the vertical housing from the interior to an exterior of the vertical housing; and impact absorbing shielding affixed to interior sidewalls of the vertical housing between the resiliently compressible slide guide and the interior sidewalls of the vertical housing.

2. The sprung dispensing tower of claim 1, wherein the impact absorbing shielding and the resiliently compressible slide guide are different materials.

3. The sprung dispensing tower of claim 2, wherein the resiliently compressible slide guide comprises a fabric and the impact absorbing shielding comprises a thermoplastic.

4. The sprung dispensing tower of claim 1, wherein the resiliently compressible slide guide comprises a fabric.

5. The sprung dispensing tower of claim 4, wherein the fabric comprises felt.

6. The sprung dispensing tower of claim 1, wherein the impact absorbing shielding comprises a thermoplastic.

7. The sprung dispensing tower of claim 6, wherein the thermoplastic is polyethylene terephthalate (PET).

* * * * *